US005226929A

United States Patent [19]

Morii et al.

[11] Patent Number: 5,226,929

[45] Date of Patent: Jul. 13, 1993

[54] ABRASIVE BRUSH

[75] Inventors: Akira Morii; Masao Yamagiwa; Mikio Hayashi, all of Niihama, Japan

[73] Assignee: Sumitomo Chemical Company, Ltd., Osaka, Japan

[21] Appl. No.: 883,170

[22] Filed: May 15, 1992

[30] Foreign Application Priority Data

May 15, 1991 [JP] Japan ..... 3-110180
Jun. 14, 1991 [JP] Japan ..... 3-143048

[51] Int. Cl.[5] ..... C09K 3/14

[52] U.S. Cl. ..... 51/298; 15/159 A; 15/159.1; 15/207.2; 51/295; 51/309

[58] Field of Search ..... 51/298, 295, 309; 15/159 A, 159 R

[56] References Cited

U.S. PATENT DOCUMENTS 3,696,563 10/1972 Rands ..... 15/159 A
3,871,139 3/1975 Rands ..... 15/159 A
3,885,358 5/1975 Enzian ..... 51/298
4,010,308 3/1977 Wiczer ..... 15/159 A
4,285,892 8/1981 Betsuda et al. ..... 15/159 A
4,507,361 3/1985 Twilley et al. ..... 15/159 A
4,751,760 6/1988 Norotta ..... 15/159 A
4,802,255 2/1989 Breuer et al. ..... 15/159 A

FOREIGN PATENT DOCUMENTS 61-176304 8/1986 Japan .
61-234804 10/1986 Japan .
61-252075 11/1986 Japan .
63-21920 1/1988 Japan .
1-222865 9/1989 Japan .
2-232174 9/1990 Japan .

*Primary Examiner*—Mark L. Bell
*Assistant Examiner*—Willie J. Thompson
*Attorney, Agent, or Firm*—Birch, Stewart, Kolasch & Birch

[57] ABSTRACT

An abrasive brush comprising at least one stick consisting of long inorganic fibers each having a diameter of 3 μm to 30 μm which are aligned and bonded with a resin, and said stick having a cross sectional area of 0.002 $mm^2$ to 2.5 $mm^2$, which can abrase a curved or intricate surface of a material to be abrased and has a large abrasion ability, large mechanical strength and consumption resistance.

19 Claims, No Drawings

ABRASIVE BRUSH

BACKGROUND OF THE INVENTION

1. Field of the Invention

The present invention relates to an abrasive brush for abrading a surface of various materials such as resins, rubbers, metals, ceramics, glass, stones, woods, composite materials, and the like. In particular, the present invention relates to an abrasive brush which is made up of sticks for abrading.

2. Description of the Related Art

It is proposed to use a monofilament which is made of a synthetic resin containing abrasive grains and has a diameter of about 0.1 mm to about 2.0 mm as a stick material of an abrasive brush.

For example, Japanese Patent Kokai Publication Nos. 176304/1986, 234804/1986 and 252075/1986 disclose a stick made of a monofilament which is produced by melt spinning a thermosetting resin containing abrasive grains and optionally further processing the spun monofilament, and a brush having improved stiffness, uniformity, abrasion and durability.

Japanese Patent Kokai Publication No. 21920/1988 discloses a brush comprising sticks each of which is made of a flat fiber consisting of an all aromatic polyamide layer and an all aromatic polyamide layer containing inorganic particles.

Japanese Patent Kokai Publication No. 232174/1989 discloses a rotating abrasion apparatus comprising a rotating axis and long inorganic fibers such as aluminum fibers which are set by a thermosetting resin with a volume ratio of the fibers being 50 to 81% by volume.

The monofilament of the thermoplastic resin containing the abrasive grains has a limit on the content of the abrasive grains in view of melt spinning. In addition, since the resin is thermoplastic, it sags, the sticks are heavily worn and its abrasion efficiency is not high. Further, the accuracy of the surface abrades with such an abrasive brush is unsatisfactory.

With the rotating brush apparatus of Japanese Patent Kokai Publication No. 232174/1989, the sticks are comparatively thick due to their forms and their cross sections are not uniform. With such sticks, it is difficult to abrade the material having a curved surface or an intricate surface. In addition, the accuracy of the abraded surface is unsatisfactory.

SUMMARY OF THE INVENTION

An object of the present invention is to provide an abrasive brush which can abrade a curved or intricate surface of a material to be abraded and has a large abrasion ability, large mechanical strength and consumption resistance.

According to the present invention, there is provided an abrasive brush comprising at least one stick consisting of long inorganic fibers each having a diameter of 3 μm to 30 μm which are aligned and bonded with a resin, and said stick having a cross sectional area of 0.002 $mm^2$ to 2.5 $mm^2$.

DETAILED DESCRIPTION OF THE INVENTION

Examples of the inorganic fiber are alumina fiber, glass fiber, ceramic fibers (e.g. silicon carbide fiber, Si-Ti-C-O fiber (so-called tilano fiber), silicon nitride fiber, silicon oxynitride fiber, etc.) and the like.

The inorganic fiber is selected according to a kind and surface hardness of the material to be abraded and/or the intended accuracy of the abraded surface. That is, the inorganic fiber having high hardness and stiffness is suitable for abrading a material having a large surface hardness or for a comparatively rough abrasion. On the contrary, the inorganic fiber having low hardness and stiffness is suitable for abrading a material having a small surface hardness or for precise surface finishing. By taking these into consideration, two or more inorganic fibers may be combined.

The inorganic fiber is selected from commercially available ones.

A shape of the inorganic fiber is a so-called long fiber. Its diameter is usually from 3 to 30 μm, preferably from 5 to 20 μm.

When the fiber diameter is larger, the abrasion performance of the brush is better while a degree of unevenness of the abrades surface is larger, namely surface roughness increases, so that the accuracy of the abrased surface of the material is not good.

When the fiber diameter is smaller, the degree of unevenness of the abrased surface is smaller, while the abrasion performance of the brush is worse and a consumption rate of the sticks is larger.

Among the inorganic fibers, the alumina fiber is preferable since the brush comprising the alumina fiber is used for abrasing a wide range of the materials from a soft one to a hard one at high efficiency.

The alumina fiber may be a known and commercially available one. In particular, a high strength high hardness alumina fiber comprising at least 60% by weight of $Al_2O_3$ and 30% by weight or less of $SiO_2$ and having a tensile strength of at least 100 $kg/mm^2$ and Mohs' hardness of at least 4 is preferred. Its diameter is usually from 5 to 30 μm, preferably from 7 to 25 μm.

Among the inorganic fibers, the glass fiber is suitable for abrasing a soft material such as a coating film at high efficiency.

The glass fiber is a known and commercially available one, namely a glass fiber produced by quickly stretching molten glass, for example, E glass fiber (alkali-free glass fiber), C glass fiber (glass fiber for chemical use), A glass fiber (general alkali-containing glass fiber), S glass fiber (high strength glass fiber), a high elastic glass fiber and the like.

Its diameter is usually from 3 to 20 μm, preferably from 3 to 15 μm.

A nerve of the sticks of the abrasive brush is selected according to the hardness of the material to be abrased and/or the accuracy of the surface of the abrased material. To adjust the nerve of the sticks, a flexible fiber may be used together with the inorganic fiber. Examples of the flexible fiber are metal fibers; synthetic fibers (e.g. rayon fibers, polyamide fibers, polyester fibers, acrylic fibers, vinylon fibers, polyethylene fibers, polypropylene fibers, polyvinyl chloride fibers, polytetrafluoroethylene fibers, etc.); natural fibers (e.g. cotton, hemp, wool, silk, KOZO (paper mulbery), MITSUMATA (*Edgeworthia chrysantha*), jute, etc.).

When two or more kinds of the fibers are combined, filaments of the fibers are mixed. When one of the fibers is a flexible fiber, a bundle of the inorganic fibers is preferably surrounded by the flexible fibers in view of reinforcing of the inorganic fibers.

The bundle of the fibers is a tow or a yarn and contains about 50 to about 2000 fibers depending on the cross sectional area of the stick.

Examples of the resin which bonds the fibers together to form the stick are thermosetting resins (e.g. epoxy resin, phenol resin, unsaturated polyester resin, vinyl ester resin, alkyd resin, urea-formalin resin, polyimide resin, etc.); thermoplastic resins (e.g. polyethylene, polypropylene, polymethyl methacrylate, polystyrene, polyvinyl chloride, ABS resin, AS resin, polyacrylamide, polyacetal, polysulfone, polycarbonate, polyphenylene oxide, polyether sulfone, polyether ketone, polyamideimide, polyvinyl alcohol, polyvinyl formal, polyvinyl butyral, etc.); and thermoplastic elastomers (e.g. styrene polymers, olefinic elastomers, polyethylene elastomers, urethane elastomers, etc.).

Among them, the epoxy resin, the phenol resin, the unsaturated polyester resin, the vinyl ester resin and the polyimide resin are preferred.

It may be possible to mix a small amount of organic or inorganic fillers in the resin or to color the resin with a pigment or a dye. In addition, the resin may be blown to form a foam and the nerve of the stick can be adjusted by a degree of expansion.

The inorganic fibers may be bonded with the resin by a per se conventional method for producing a composite material of the fibers and the resin. For example, according to a method for producing a prepreg sheet, tow pregreg and yarn prepreg, a bundle of the specific number of the long fibers or sheet form long fibers are aligned and impregnated with the above resin. When the resin is the thermosetting one, an uncured or half-cured resin as such or a solution of the resin is used. When the resin is the thermoplastic one, it is used in a molten form or a solution form.

The impregnated resin is hardened by a known method suitable for the respective resin. In the case of the thermosetting resin, when the solvent is used, it is evaporated off, and the residual resin is heated and cured. When no solvent is used, the impregnated resin is heated and cured. In the case of the thermoplastic resin, when the solvent is used, it is evaporated off whereby the resin is hardened. When the molten resin is used, it is cooled to harden it.

A content of the inorganic fiber in the stick is from 20 to 90% by volume, preferably from 40 to 80% by volume. When the content of the inorganic fiber is less than 20% by volume, the stick has a low abrasion performance and the abrased surface of the material is uneven and its accuracy is low. When it exceeds 90% by volume, many parts in the bundle of the fibers are not filled with the resin so that the shape of the stick is hardly maintained and the long fiber tends to be broken.

The stick made of the inorganic fibers which are bonded with the resin has a cross sectional area of from 0.002 to 2.5 $mm^2$, preferably from 0.005 to 1 $mm^2$. When the cross sectional area of the stick is too small, handling of the fiber bundle is difficult during the production of the stick, and the stick tends to be broken during the manufacture of the abrasive brush. When the cross sectional area of the stick is too large, though the abrasion performance is high, the unevenness of the abrased surface becomes large and a width of a formed groove or a distance between the adjacent grooves is nonuniform, so that the abrasion accuracy is deteriorated.

Among the sticks, a stick made of the alumina fibers bonded with the resin has a cross sectional area of from 0.01 to 2.5 $mm^2$, preferably from 0.02 to 1 $mm^2$.

A stick made of the glass fibers bonded with the resin has a cross sectional area of from 0.002 to 1.5 $mm^2$, preferably from 0.005 to 1 $mm^2$.

The suitable cross sectional area of the stick is determined according to the final use of the abrasive brush, and can be adjusted by selecting the diameter of the long fiber, the number of the long fibers, a volume ratio of the fibers to the resin, and the like.

That is, when the tow or the yarn is used, the bonded fibers as such can be used, or the bonded fibers may be split or a part of the fibers may be removed to reduce the cross sectional area. When the prepreg sheet is used, the bonded fiber sheet is cut along the fiber directions at a suitable width. In this case, the cross sectional area is adjusted by the thickness of the sheet and the cut width.

A shape of the cross section of the stick may be any shape and selected according to the final use of the abrasive brush. For example, the cross section may be round, ellipsoidal, polygonal (e.g. triangle, square, rectangular, hexagonal, etc.), star-form or flattened. The fibers may be twisted. Such shape is imparted to the stick before the resin is hardened.

The abrasive brush of the present invention may be in the form of a roll brush, a flat brush, a channel brush, a cup brush, a wheel brush, a high density brush, a bar brush, and the like.

A length of the stick is selected according to the kind of the brush. The sticks may be arranged in any conventional pattern in the brush, for example, in a linear pattern, a spiral pattern, a zigzag pattern or a radial pattern.

A material which constitutes the brush other than the stick may be any one of conventional materials.

The abrasive brush of the present invention can be produced by a per se conventional method for producing the abrasive brush. In general, the sticks are collected, arranged and filled. In the production of the brush, the unhardened sticks may be used.

The abrasive brush of the present invention can be used for abrasing the material by a conventional abrasing method.

The abrasive brush of the present invention comprises the sticks which have uniform properties, the nerve of which is adjusted and which are excellent in mechanical strength and consumption resistance. In addition, the sticks have good corrosion resistance and acid resistance. Therefore, the sticks do not react with the material to be abrased with the brush. Since the sticks have a large coefficient of thermal conductivity, the brush is not greatly influenced by friction heat, so that the material which is not abrased by the conventional abrasion brush can be abrased at a high abrasion efficiency with good accuracy under conditions under which the conventional abrasion brush is not used.

When the abrasive brush of the present invention is used for abrasing various materials such as metals (e.g. steel, aluminum, alloys, etc.), glass, resins, rubbers, ceramics, composite materials, and the like, consumption of the sticks is less than the conventional sticks made of the synthetic resin containing the abrasive grains or the all aromatic polyamide, and the brush is excellent in its abrasion ability and uniformity of the surface roughness of the abrased material in comparison with the conventional abrasive brush.

The abrasive brush comprising the sticks made of the alumina fibers having the selected cross sectional areas of each fiber and each stick has excellent abrasion ability when it is used for abrasing the materials having very different hardness from steel to the resins.

The abrasive brush comprising the sticks made of the glass fiber is excellent in abrasion ability for the soft material to be abrased such as aluminum alloys, the resins and the coating film.

In addition, the abrasive brush of the present invention is useful to achieve precise surface roughness of coated layers with eliminating height difference and prevent peeling off of the coated layers through the increase of a so-called anchor effect, when plural layers of coatings such as epoxy resin coating, melamine alkyd resin coating, polyester coating, acrylic resin coating and the like are formed on a steel plate.

In particular, the abrasive brush of the present invention is useful for abrasion of the coating in a coating line of automobile production, abrasion of various processing rolls, microscratch processing of printed circuit boards and lead frames, abrasion of heating conveyer nets, abrasion or grinding in iron manufacture, and the like.

PREFERRED EMBODIMENTS OF THE PRESENT INVENTION

The present invention will be illustrated by the following Examples, which do not limit the scope of the present invention. In Examples, "parts" are by weight.

An abrasive brush was produced using sticks fabricated in each Example in the form of a cup-type rotating brush having an outer diameter of 120 mm, a width of 35 mm and a stick length of 30 mm.

An abrasive property of each abrasive brush was evaluated by abrasing each of three samples, namely a steel plate (S45C, Vickers hardness of 700, a center line average roughness Ra=0.03 μm, maximum height Rmax=0.5 μm), an aluminum plate (5052 pure aluminum, Shore hardness of 15, Ra =0.3 μm, Rmax =2.3 μm) and a steel plate coated with an acrylic resin coating (manufactured by Shito Paint Co., Ltd., Rockwell hardness (ASTM D 785) of M100, Ra=0.02 μm, Rmax=0.5 μm) of a thickness of 50 μm, at a brush revolution rate of 1000 rpm, under a load of 0.3 kg/cm$^2$ for 30 minutes with water flowing. Then, the surface roughness of the abrased surface and the consumption rate of the sticks were measured.

The surface roughness of the abrased surface was evaluated using a contact surface roughness meter (SURFCOM (trade name) manufactured by Tokyo Seimitsu Co., Ltd.) by scanning the surface in a direction perpendicular to the abrasion direction to measure the center line average roughness Ra (μm) and the maximum height Rmax (μm).

The consumption rate (%) of the sticks was calculated by weighing the weight of the brush before and after abrasion after drying the brush at 100° C, for 2 hours and calculating a weight decrease rate.

$$\text{Consumption rate} = \frac{\text{Brush weight before abrasion} - \text{brush weight after abrasion}}{\text{Brush weight before abrasion}} \times 100$$

EXAMPLE 1

A bisphenol A epoxy resin (Sumiepoxy (trademark) ELA-134 manufactured by Sumitomo Chemical Co., Ltd.) (60 parts), a cresol novolak epoxy resin (Sumiepoxy (trademark) ESCN-220 manufactured by Sumitomo Chemical Co., Ltd.) (40 parts), dicyanediamide (5 parts) and 3-(3,4-dichlorophenyl)-1,1-dimethylurea (4 parts) were mixed in trichloroethylene to prepare a solution having a solid content of 30% by weight.

A continuous long fiber toe containing 250 alumina fibers each having a diameter of 10 μm (Altex (trademark) manufactured by Sumitomo Chemical Co., Ltd.; 85% by weight of $Al_2O_3$ and 15% by weight of $SiO_2$) was dipped in the above prepared solution of the epoxy resins and heated at 170° C. for 30 minutes and then at 200° C. for 3 minutes in an oven with internal air circulation to cure the epoxy resins. Thereafter, the toe was wound around a drum having a diameter of 30 cm to obtain a stick material having a fiber volume content (Vf) of 60% and a cross sectional area of 0.03 mm$^2$.

Using this stick material, two cup type rotating brushes with 62% of a volume filling rate of the sticks. With one of them, the steel plate was abrased. The results are shown in Table 1.

EXAMPLE 2

Using the other one of the brushes produced in Example 1, the acryl resin coated steel plate was abrased. The results are shown in Table 1.

EXAMPLE 3

In the same manner as in Example 1 but using a toe containing 500 Altex fibers as used in Example 1, a stick material having Vf of 60% and a cross sectional area of 0.07 mm$^2$ was fabricated and two cup type rotating brushes each having the volume filling rate of sticks of 60% were produced. With one of them, the steel plate was abrased. The results are shown in Table 1.

EXAMPLE 4

Using the other one of the brushes produced in Example 3, the acryl resin coated steel plate was abrased. The results are shown in Table 1.

EXAMPLE 5

In the same manner as in Example 3, a stick material having Vf of 40% and a cross sectional area of 0.1 mm$^2$ was fabricated and then two cup type rotating brushes having the volume filling rate of sticks of 60% were produced. With one of them, the steel plate was abrased. The results are shown in Table 1.

EXAMPLE 6

Using the other one of the brushes produced in Example 5, the acryl resin coated steel plate was abrased. The results are shown in Table 1.

EXAMPLE 7

In the same manner as in Example 1 but using a toe of 1000 Altex fibers each having a diameter of 20 μm, a stick material having Vf of 60% and a cross sectional area of 0.52 mm$^2$ was fabricated and then two cup type rotating brushes each having the volume filling rate of sticks of 40 were produced. With one of them, the steel plate was abrased. The results are shown in Table 1.

EXAMPLE 8

Using the other one of the brushes produced in Example 7, the acryl resin coated steel plate was abrased. The results are shown in Table 1.

EXAMPLE 9

Around a periphery of a toe containing 500 Altex fibers each having a diameter of 10 μm as a core, rayon staple fibers were reciprocally wound each 500 times per one meter. A volume ratio of Altex to the rayon staple fiber was 1:1. Then this bundle of the fibers was impregnated with the same solution of the epoxy resins as prepared in Example 1 to obtain a stick material having Vf (in terms of the total volume of Altex and the rayon staple fibers) of 60% and a cross sectional area of 0.13 $mm^2$. Using this stick material, two cup type rotating brushes each having the volume filling rate of sticks of 55% were produced. With one of them, the steel plate was abrased. The results are shown in Table 1.

EXAMPLE 10

Using the other one of the brushes produced in Example 9, the acryl resin coated steel plate was abrased. The results are shown in Table 1.

EXAMPLE 11

In the same manner as in Example 1 but using a continuous long fiber yarn of using glass fibers each having a diameter of 5 μm (ECE 225-1/0 1Z; E glass sized for epoxy resin coating, 11.2 Tex, manufactured by Nitto Boseki Co., Ltd.), a stick material having Vf of 60% and a cross sectional area of 0.07 $mm^2$ was fabricated and then two cup type rotating brushes each having the volume filling rate of sticks of 70% were produced. With one of them, the aluminum plate was abrased. The results are shown in Table 1.

EXAMPLE 12

Using the other one of the brushes produced in Example 11, the acryl resin coated steel plate was abrased. The results are shown in Table 1.

EXAMPLE 13

In the same manner as in Example 1 but using a continuous long fiber yarn of glass fibers eahc having a diameter of 9 μm (ECG 37-1/3 3.35; E glass sized for epoxy resin coating, 405 Tex, manufactured by Nitto Boseki Co., Ltd.), a stick material having Vf of 60% and a cross sectional area of 0.263 $mm^2$ was fabricated and the two cup type rotating brushes each having the volume filling rate of sticks of 45% were produced. With one of them, the aluminum plate was abrased. The results are shown in Table 1.

EXAMPLE 14

Using the other one of the brushes produced in Example 13, the acryl resin coated steel plate was abrased. The results are shown in Table 1.

EXAMPLE 15

In the same manner as in Example 13 but fabricating a stick material having Vf of 40% and a cross sectional area of 0.394 $mm^2$, two cup type rotating brushes each having the volume filling rate of sticks of 45% were produced. With one of them, the aluminum plate was abrased. The results are shown in Table 1.

EXAMPLE 16

Using the other one of the brushes produced in Example 15, the acryl resin coated steel plate was abrased. The results are shown in Table 1.

EXAMPLE 17

In the same manner as in Example 1, a mixed yarn of a continuous long fiber yarn of a glass fiber having a o diameter of 9 μm (ECG 37-1/3 3.3S; E glass sized for epoxy resin coating, 405 Tex, manufactured by Nitto Boseki Co., Ltd.) and a continuous long fiber toe of the same Altex alumina fiber as used in Example 1 in a volume ratio of 2:1 which were aligned in a bundle length in parallel was impregnated with the epoxy resin solution and cured to obtain a stick material having Vf (the total volume of the glass fiber and Altex) of 60% and a cross sectional area of 0.394 $mm^2$, and two cup type rotating brushes each having the volume filling rate of sticks of 45% were produced. With one of them, the aluminum plate was abrased. The results are shown in Table 1.

EXAMPLE 18

Using the other one of the brushes produced in Example 17, the acryl resin coated steel plate was abrased. The results are shown in Table 1.

COMPARATIVE EXAMPLE 1

In the same manner as in Example 1 but using, as a stick material, Torayglit (trade name) No. 153-0.55W-50C (Nylon 6 containing 30% by weight of aluminum oxide powder with an average particle size of #500 and having a cross sectional area of 0.24 $mm^2$ manufactured by Toray Monofilament Co., Ltd.), three cup type rotating brushes each having the volume filling rate of sticks of 42% were produced. With first one of them, the steel plate was abrased. The results are shown in Table 2.

COMPARATIVE EXAMPLE 2

Using second one of the brushes produced in Comparative Example 1, the acryl resin coated steel plate was abrased. The results are shown in Table 2.

COMPARATIVE EXAMPLE 3

Using the last one of the brushes produced in Comparative Example 1, the aluminum plate was abrased. The results are shown in Table 2.

COMPARATIVE EXAMPLE 4

In the same manner as in Example 1 but using, as a stick material, Conex Brissle (trade name) (all aromatic polyamide containing 10% by volume of aluminum oxide powder with an average particle size of 10 μm and having a cross sectional area of 0.1 $mm^2$ manufactured by Teijin), three cup type rotating brushes each having the volume filling rate of sticks of 53% were produced. With first one of them, the steel plate was abrased. The results are shown in Table 2.

COMPARATIVE EXAMPLE 5

Using second one of the brushes produced in Comparative Example 4, the acryl resin coated steel plate was abrased. The results are shown in Table 2.

COMPARATIVE EXAMPLE 6

Using the last one of the brushes produced in Comparative Example 4, the aluminum plate was abrased. The results are shown in Table 2.

COMPARATIVE EXAMPLE 7

In the same manner as in Example 1 but using a toe containing 2000 Altex alumina fibers each having a diameter of 35 μm, a sick material having Vf of 60% and a cross sectional area of 3.2 $mm^2$ was fabricated and two cup type rotating brushes each having the volume filling rate of sticks of 30% were produced. With one of them, the steel plate was abrased. The results are shown in Table 2.

COMPARATIVE EXAMPLE 8

Using the other of the brushes produced in Comparative Example 7, the acryl resin coated steel plate was abrased. The results are shown in Table 2.

COMPARATIVE EXAMPLE 9

In the same manner as in Example 1, a stick material having Vf of 40% and a cross sectional area of 2.140 $mm^2$ was fabricated from a continuous long fiber roving of glass fiber having a diameter of 23 μm (RS 220 RL-515; E glass sized for epoxy resin coating, 2200 Tex, Nitto Boseki Co., Ltd.) and two cup type rotating brushes each having the volume filling rate of sticks of 30% were produced. With first one of them, the aluminum plate was abrased. The results are shown in Table 2.

COMPARATIVE EXAMPLE 10

Using second one of the brushes produced in Comparative Example 9, the acryl resin coated steel plate was abrased. The results are shown in Table 2.

TABLE 1

| Example No. | Ra (μm) | Rmax (μm) | Rmax/Ra | Consumption rate (%) |
|---|---|---|---|---|
| 1 | 0.3 | 2 | 7 | <0.1 |
| 2 | 0.4 | 3 | 8 | ↑ |
| 3 | 1.3 | 12 | 9 | ↑ |
| 4 | 2.0 | 18 | 9 | ↑ |
| 5 | 1.2 | 10 | 8 | ↑ |
| 6 | 1.8 | 17 | 9 | ↑ |
| 7 | 2.6 | 36 | 14 | ↑ |
| 8 | 3.7 | 48 | 13 | ↑ |
| 9 | 1.1 | 9 | 8 | 0.4 |
| 10 | 1.7 | 14 | 8 | 0.3 |
| 11 | 0.8 | 4 | 5 | <0.1 |
| 12 | 0.1 | 0.6 | 6 | ↑ |
| 13 | 7.5 | 60 | 8 | ↑ |
| 14 | 1.6 | 13 | 8 | ↑ |
| 15 | 6.3 | 50 | 8 | ↑ |
| 16 | 1.4 | 10 | 7 | ↑ |
| 17 | 12 | 120 | 10 | ↑ |
| 18 | 3.2 | 35 | 11 | ↑ |

TABLE 2

| Comparative Example No. | Ra (μm) | Rmax (μm) | Rmax/Ra | Consumption rate (%) |
|---|---|---|---|---|
| 1 | 0.02 | 0.5 | 25 | 2.5 |
| 2 | 0.03 | 0.7 | 23 | 1.8 |
| 3 | 0.08 | 2 | 25 | 1.6 |
| 4 | 0.03 | 0.8 | 27 | 1.5 |
| 5 | 0.03 | 0.8 | 27 | 1.0 |
| 6 | 0.2 | 6 | 30 | 0.9 |
| 7 | 4.3 | 95 | 22 | <0.1 |
| 8 | 5.5 | 120 | 22 | ↑ |
| 9 | 4.5 | 90 | 20 | ↑ |
| 10 | 1.0 | 20 | 20 | ↑ |

What is claimed is:

1. An abrasive brush comprising at least one stick consisting of long inorganic fibers selected from the group consisting of alumina fibers, glass fibers, silicon nitride fibers, silicon carbide fibers, tilano fibers and silicon oxynitride fibers each having a diameter of 3 μm to 30 μm which are aligned and bonded with a resin selected from the group consisting of thermosetting resins, thermoplastic resins and thermoplastic elastomers and said stick having a cross sectional area of 0.002 $mm^2$ to 2.5 $mm^2$.

2. The abrasive brush according to claim 1, wherein said stick is produced by aligning alumina long fibers having a diameter of 5 to 30 μm and bonded with a resin and has a cross sectional area of 0.01 to 2.5 $mm^2$.

3. The abrasive brush according to claim 1, wherein said stick is produced by aligning glass long fibers having a diameter of 3 to 20 μm and bonded with a resin and has a cross sectional area of 0.002 to 1.5 $mm^2$.

4. The abrasive brush according to claim 1 wherein the inorganic fibers are alumina fibers comprising at least 60% by weight of $Al_2O_3$ and 30% by weight or less of $SiO_2$ and having a tensile strength of at least 100 $kg/mm^2$ and Mohs' hardness of at least 4.

5. The abrasive brush according to claim 4 where each fiber has a diameter of 7 to 25 μm.

6. The abrasive brush according to claim 1 where the inorganic fibers are glass fibers selected from the group consisting of E glass fiber, C glass fiber, A glass fiber, S glass fiber and high elastic glass fiber.

7. The abrasive brush according to claim 6 where each fiber has a diameter of 3 to 20 μm.

8. The abrasive brush according to claim 6 where each fiber has a diameter of 3 to 15 μm.

9. The abrasive brush according to claim 1 which additionally contains a flexible fiber selected from the group consisting of metal fibers, synthetic fibers and natural fibers.

10. The abrasive brush according to claim 1 which additionally contains a flexible fiber selected from the group consisting of rayon fibers, polyamide fibers, polyester fibers, acrylic fibers, vinylon fibers, polyethylene fibers, polypropylene fibers, polyvinyl chloride fibers, polytetrafluoroethylene fibers, cotton, hemp, wool, silk, paper mulbery and jute.

11. The abrasive brush according to claim 3 wherein the resin is selected from the group consisting of epoxy resin, phenol resin, unsaturated polyester resin, vinyl ester resin, alkyd resin, ureaformalin resin, polyamide resin, polyethylene, polypropylene, polymethyl methacrylate, polystyrene, polyvinyl chloride, ABS resin, AB resin, polyacrylamide, polyacetal, polysulfone, polycarbonate, polyphenylene oxide, polyether sulfone, polyether ketone, polyamideimide, polyvinyl alcohol, polyvinyl formal, polyvinyl butyral, styrene polymers, olefinic elastomers, polyethylene elastomers, urethane elastomers.

12. The abrasive brush according to claim 3 wherein the resin is selected from the group consisting of epoxy resin, phenol resin, unsaturated polyester resin, vinyl ester resin and polyamide resin.

13. The abrasive brush according to claim 1 wherein the content of inorganic fibers in the stick is from 20 to 90% by volume.

14. The abrasive brush according to claim 1 wherein the content of the inorganic fibers in the stick is from 40 to 80% by volume.

15. The abrasive brush according to claim 1 wherein said stick has a cross sectional area of 0.005 to 1 $mm^2$.

16. The abrasive brush according to claim 2 wherein said stick has a cross sectional area of from 0.02 to 1 $mm^2$.

17. The abrasive brush according to claim 3 wherein said stick has a cross sectional area of from 0.005 to 1 $mm^2$.

18. The abrasive brush according to claim 1 wherein said stick has a cross sectional shape that is round, ellipsoidal, polygonal, star-form or flattened.

19. The abrasive brush according to claim 1 which is in the form of a roll brush, a flat brush, a channel brush, a cup brush, a wheel brush, a high density brush or a bar brush.

* * * * *